US005588524A

United States Patent [19]

Wu

[11] Patent Number: 5,588,524

[45] Date of Patent: Dec. 31, 1996

[54] PUSH WHEEL SWITCH

[76] Inventor: Ching-Lung Wu, P.O. Box No. 2103, Taichung City, Taiwan

[21] Appl. No.: 540,553

[22] Filed: Oct. 6, 1995

[51] Int. Cl.[6] ..... H01H 13/00

[52] U.S. Cl. ..... 200/552; 200/5 E

[58] Field of Search ..... 200/529, 530, 200/531, 336, 337, 341, 526, 527, 528, 61.36, 61.37, 5 E, 27 R, 552, 117 W

[56] References Cited

U.S. PATENT DOCUMENTS 3,626,452 12/1971 Winter ..... 200/552
3,654,413 4/1972 Jordan et al. ..... 200/552
4,780,584 10/1988 Sakakino et al. ..... 200/552
4,939,325 7/1990 Wendel et al. ..... 200/552

*Primary Examiner*—David J. Walczak
*Attorney, Agent, or Firm*—Morton J. Rosenberg; David I. Klein

[57] ABSTRACT

A push wheel switch including a housing, a toothed wheel rotatably disposed in the housing and two push buttons for controlling the rotation of the toothed wheel. The push buttons are depressed to rotate the toothed wheel so as to changedly show numerals on a numeral face of the toothed wheel. In the case that the toothed wheel is located and prevented from rotating by locating block, when the push button is again depressed, the push button will slip off without driving the toothed wheel.

4 Claims, 10 Drawing Sheets

PUSH WHEEL SWITCH

BACKGROUND OF THE INVENTION

The present invention relates to a push wheel switch for controlling various kinds of digital mechanisms.

FIG. 1A shows a conventional push wheel switch including a housing (not shown), a set of push buttons 2 and a gear 3 disposed with numerals. The tooth face 31 of the gear 3 next to the upper/lower limit of the rotatable range being controlled is designed with an inclined surface so as to guide a gear driving arm 21 of the push button 2 to slip off from the tooth face 31 without rotating the gear 3. Two insertion pins 11 are respectively disposed next to the upper/lower limit of the set range, adjacent to the stopper block 32 for stopping the gear 3 from rotating. FIG. 1B shows that the inclined tooth face 31 has a higher H end and a lower L end, whereby when the gear driving arm 21 of the push button 2 presses the tooth face 31, the gear driving arm 21 slides toward the L end and separates from the tooth face 31.

Such a gear 3 with a specific inclined tooth face 31 is difficult to manufacture. Moreover, the stopper block 32 for restricting the rotation of travel of the gear 3 is disposed between elements 2 and 3 so that the volume of the stopper block 32 is limited. As a result, when the insertion pin 11 abuts against the stopper block 32, the stopper block 32 is often broken by the insertion pin 11.

In addition, two arch-shaped spaces are formed between the two insertion pins 11 of the gear 3. Therefore, without any definite indication, an operator often fails to identify which arch-shaped space is the correct numeral interval and thus mistakes often happen in the assembling procedure.

SUMMARY OF THE INVENTION

It is therefore a primary object of the present invention to provide a push wheel switch in which by means of setting the contacting angle and forcing angle between the wheel driving arm and the tooth face of the toothed wheel, when the force exerted by the wheel driving arm onto the tooth face is less than the resistance of the stopper block against the arch block, the wheel driving arm is guided by the tooth face to slip aside away from the tooth face. Accordingly, the specific inclined tooth face is no longer necessary.

The present invention can be best understood through the following description and accompanying drawing, wherein:

DETAILED DESCRIPTION OF THE PREFERRED EMBODIMENTS

Please refer to FIGS. 2 to 9. The push wheel switch of the present invention includes a housing 4, a toothed wheel 5, two push buttons 6 and a circuit board cover 7.

Figure 1A:
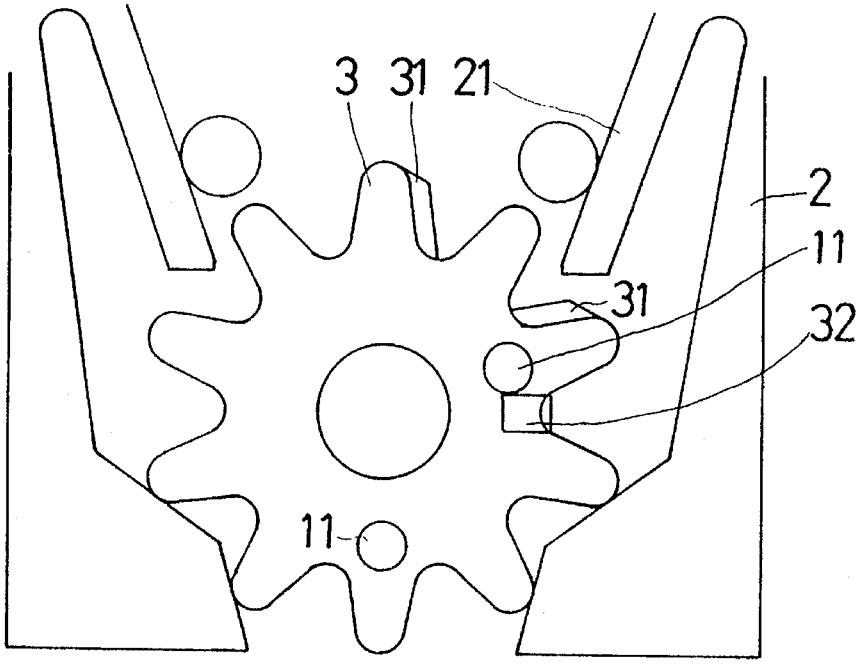
PRIOR ART FIG. 1A
FIGS. 1A and 1B show a conventional push wheel switch.
Figure 1B:
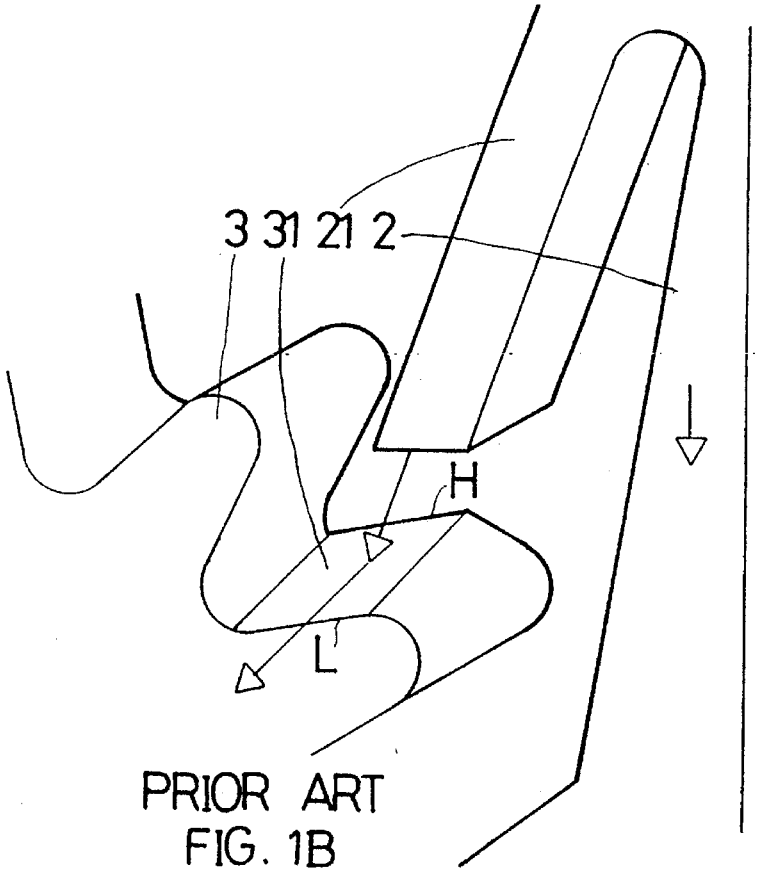
PRIOR ART FIG. 1B
Figure 3:
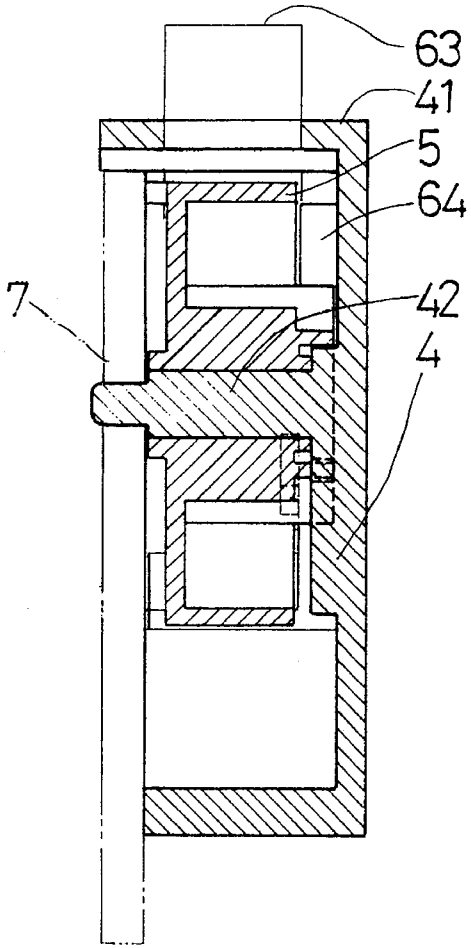
FIG. 3 is a side sectional view of the embodiment of FIG. 2.
Figure 2:
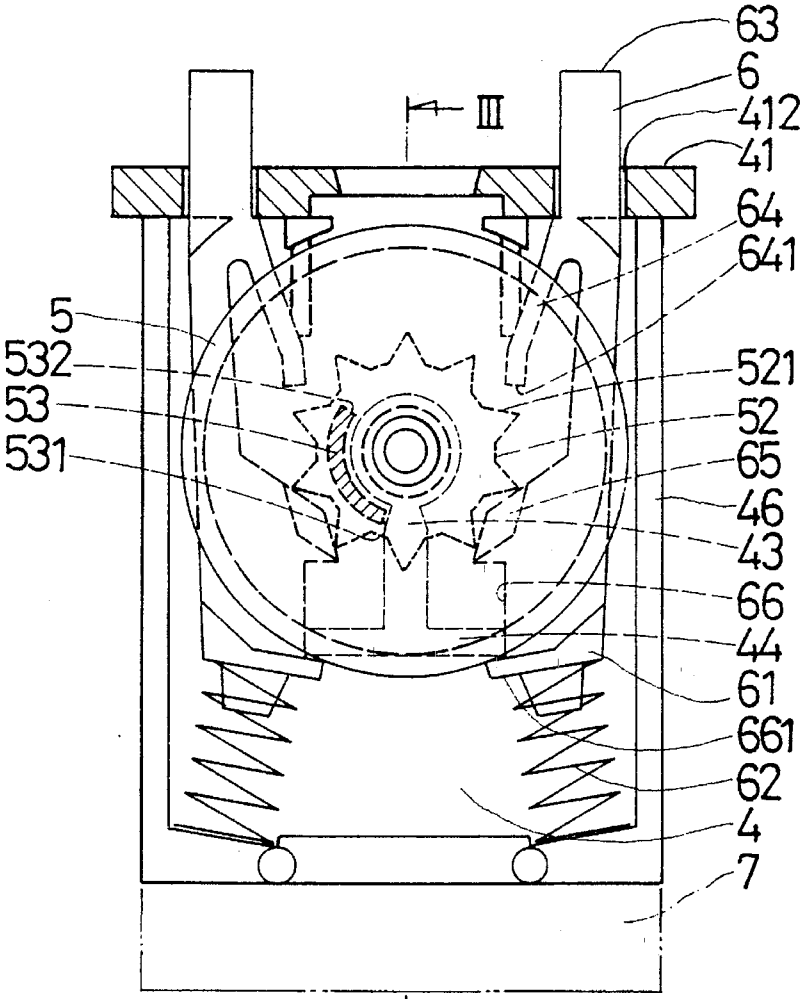
FIG. 2 is a front sectional view of an embodiment of the present invention.
Figure 5:
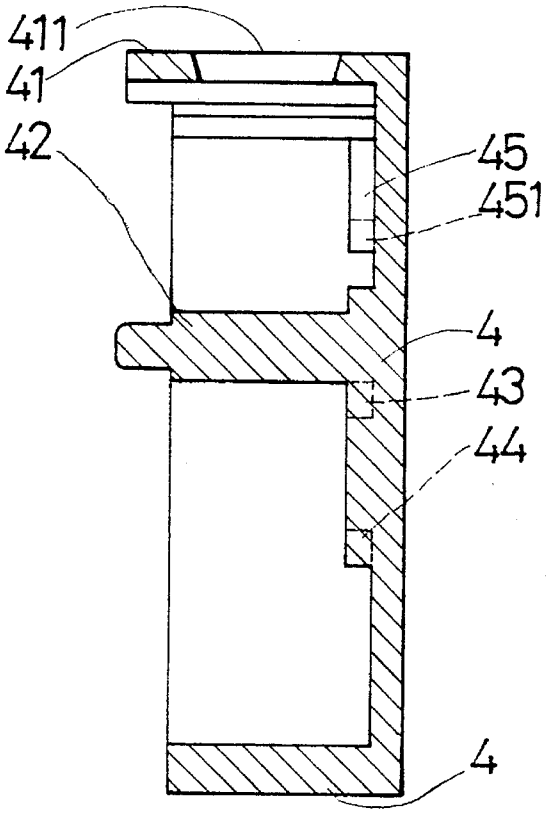
FIG. 5 is a side sectional view according to FIG. 4.
Figure 4:
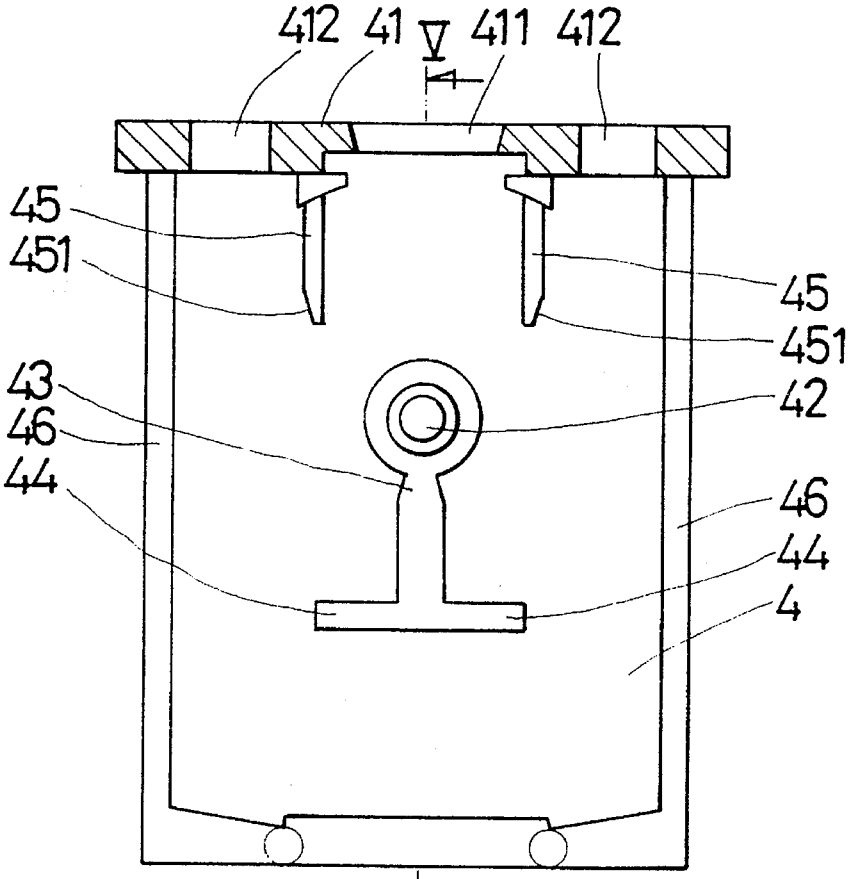
FIG. 4 is a front sectional view of the housing of the present invention.

Please refer to FIGS. 4 and 5. The housing 4 has two walls 46 and a panel 41 formed with a window 411 for showing the numerals of the toothed wheel 5 and two holes 412 for the top ends 63 of the push buttons 6 to extend through. The housing 4 further has an inner shaft seat 42 about which the toothed wheel 5 is rotated. The shaft seat 42 has connected thereto a first stopper block 43 extending away from the panel 41 and in a direction parallel to the two side walls 46. At the distal end of the first stopper block 43 are formed two second stopper blocks 44, each of which is directed orthogonally with respect to the direction of the first stopper block 43. Two rails are disposed under the panel 41 respectively near the two holes 412. The free end of each rail 45 is formed with an inclined face 451 extending downward from the lateral wall 46 of the housing 4 toward the center thereof. The inclined face 451 contacts with a wheel driving arm 64 of the push button 6 and guides the wheel driving arm 64 to move downward into the tooth spaces 52 of the toothed wheel 5.

Figure 7:
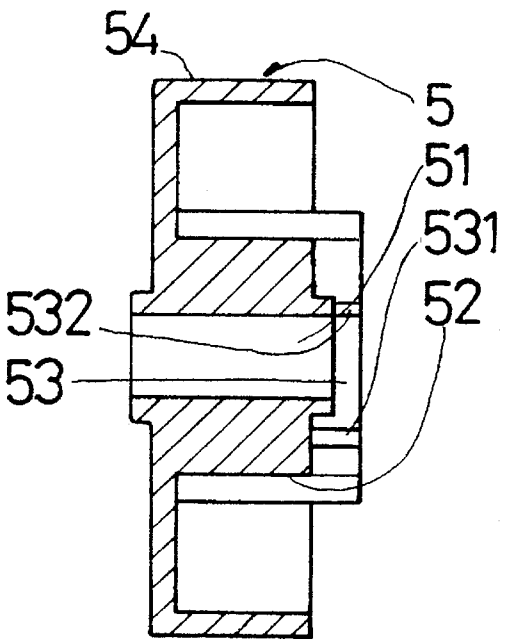
FIG. 7 is a side sectional view according to FIG. 6.
Figure 6:
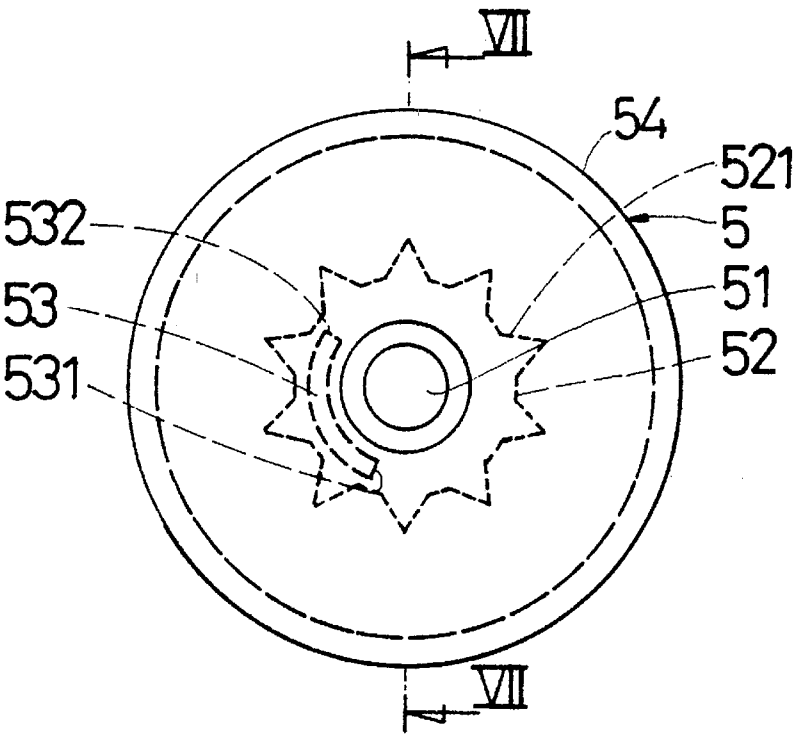
FIG. 6 is a front sectional view of the toothed wheel of the present invention.

Please refer to FIGS. 6 and 7. The toothed wheel 5 is formed with a shaft hole 51 to rotatably receive therein the shaft seat 42 of the housing 4. Multiple tooth spaces 52 are formed on the outer periphery of the shaft hole 51. Each tooth space 52 is defined by a pair of opposing tooth faces 521. The tooth spaces 52 and the tooth faces 521 have identical profiles and the number of the tooth spaces 52 is equal to the number of predetermined numerals on a numeral face 54 of the toothed wheel 5. Accordingly, each time the push button 6 is depressed, the wheel driving arm 64 rotates the toothed wheel 5 through an angle corresponding to one tooth space 52, and the numeral face 54 of the toothed wheel 5 is rotated by one numeral. An arch block 53 is disposed between the tooth spaces 52 and the shaft hole 51 for setting the interval between two numerals. The arch block 53 extends by a certain length from a start end 531 along the outer periphery of the shaft hole 51 to a finish end 532. When the numeral 0 of the toothed wheel 5 is positioned at the window 411, the start end 531 of the arch block 53 abuts against one side of the first stopper block 43 located between the tooth spaces 52 corresponding to the numerals 4 and 5. At this time, the start end 531 and the finish end 532 are restricted by the first stopper block 43 of the housing 4, permitting the toothed wheel 5 to be rotated back and forth between two set numerals.

Figure 9:
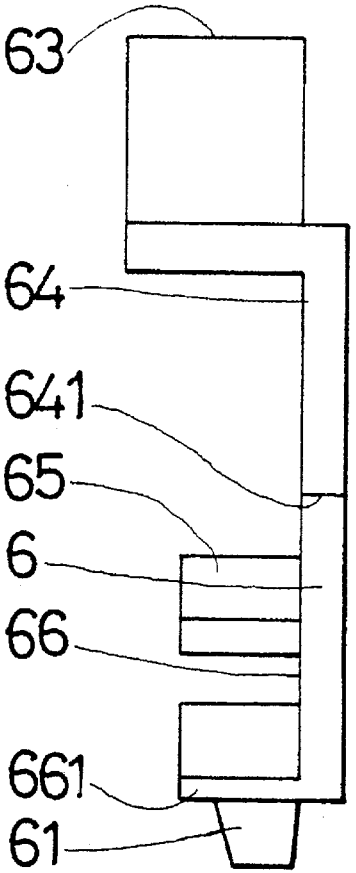
FIG. 9 is a side sectional view according to FIG. 8.
Figure 8:
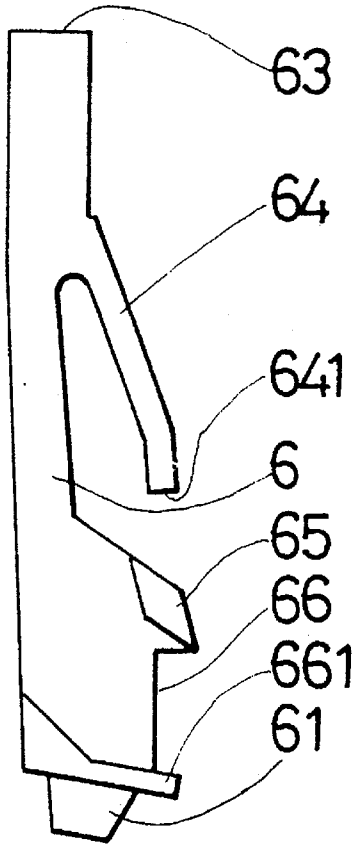
FIG. 8 is a front sectional view of the push button of the present invention.

Please refer to FIGS. 8 and 9. Each push button 6 has a base seat 61 forced by a spring 62 to make the top end 63 of the push button 6 protrude out of the hole 412 of the housing 4. When the spring 62 is released, the base seat 61 of the push button 6 abuts the second stopper block 44 of the housing 4, thus allowing the push button top end 63 to protrude through the hole 412 by a predetermined amount. The wheel driving arm 64 of each push button 6 is inclined inward, away from a respective wall 46, toward the tooth spaces 52 of the toothed wheel 5. The wheel driving arm 64 has a rectangular cross-section. The thickness of the wheel driving arm 64 perpendicular to the axis of the toothed wheel 5, is less than the width of the wheel driving arm 64 parallel to the axis of the toothed wheel 5. The bottom end 641 of the wheel driving arm 64 faces one tooth face 521 of the toothed wheel 5.

Figure 10:
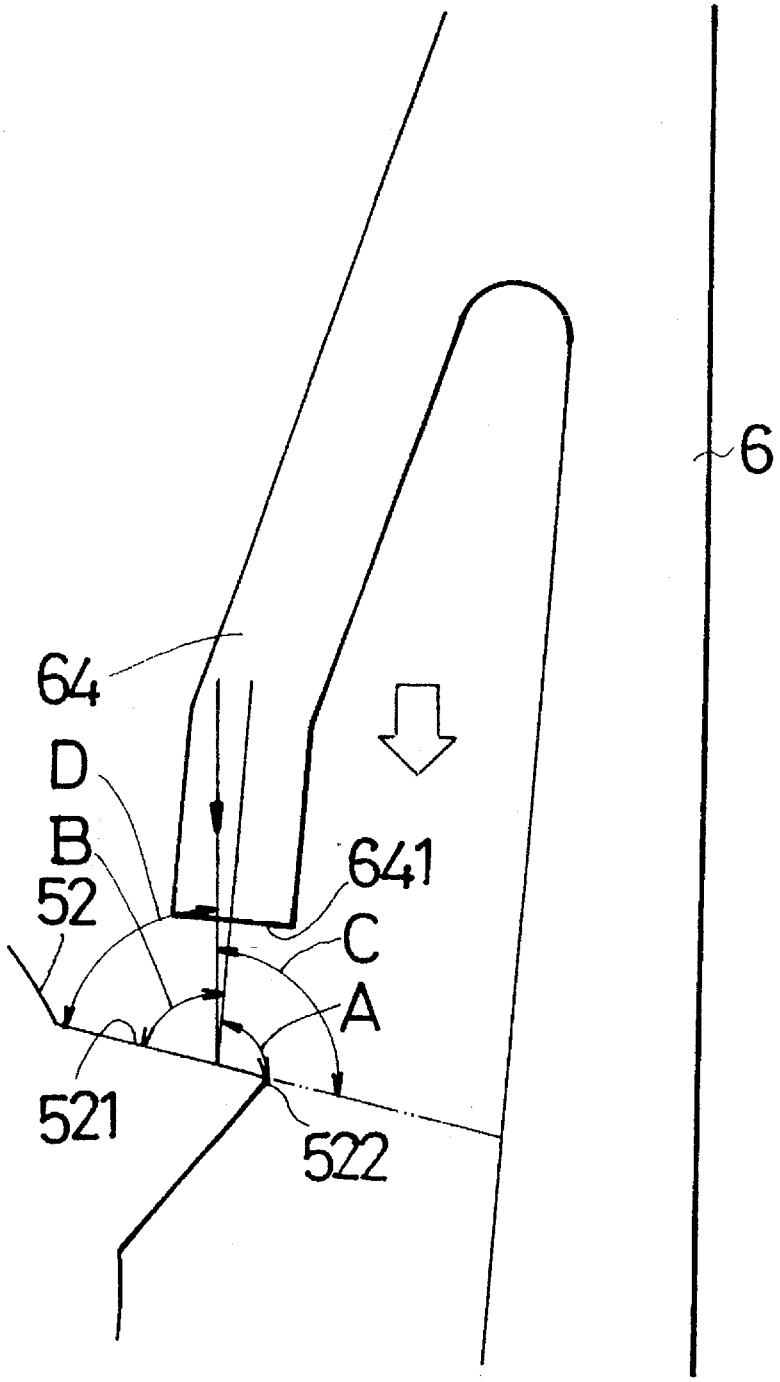
FIG. 10 is a view in which the force for rotating the toothed wheel is analyzed.
Figure 11:
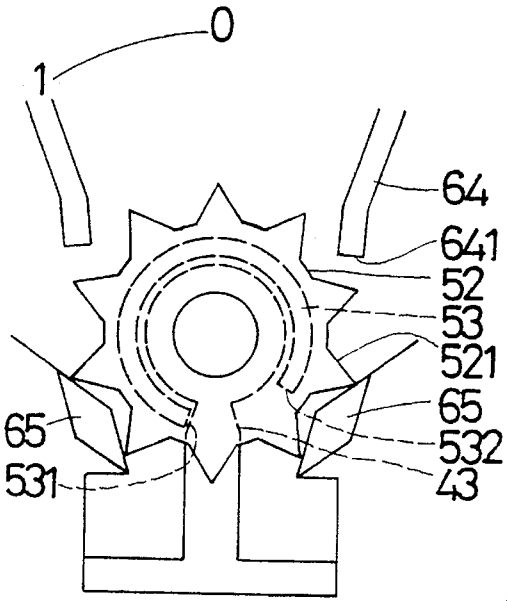
FIGS. 11 to 19 respectively show that the set numeral ranges of the present invention are 0-1, 0-2, 0-3, 0-4, 0-5, 0-6, 0-7, 0-8 and 0-9.

Referring to FIG. 10, a first outer angle A and a complementary first inner angle B are defined between the center line of the wheel driving arm 64 and the tooth face 521. The first outer angle A is proximal to the lateral wall 46 of the housing 4 and larger than the first inner angle B. When the bottom end 641 is urged downward against the tooth face 521 by an action force, a second outer angle C and a complementary second inner angle D are defined between the direction of the action force and the tooth face 521. The second outer angle C is proximal to the lateral wall 46 of the housing 4 and larger than the second inner angle D. Accordingly, the bottom end 641 contacts the tooth face 521 and drives the same. The wheel driving arms 64 further have lower locating blocks 65 for respectively extending into left lower and right lower tooth spaces 52 of the toothed wheel 5 as shown in FIG. 11. A slide rail 66 is disposed under the locating block 65 for abutting against the second stopper block 44 of the housing 4. The bottom end of the slide rail 66 is formed with a projection 661 to be stopped by the second stopper block 44 in order to limit the height by which the top end 63 of the push button 6 protrudes out of the hole 412.

The housing 4, toothed wheel 5, push buttons 6 and the circuit board cover 7 are assembled to form the push wheel switch. By means of the circuit contacts (not shown) of the toothed wheel 5, a signal is transmitted from the circuit board cover 7 to a controller (not shown).

When one push button 6 is depressed, downward against the force of spring 62, the slide rail 66 descends along the second stopper block 44, and the wheel driving arm 64 and the locating block 65 also moved downward. The wheel driving arm 64 along the rail 45 is inclinedly inserted into one tooth space 52 on a lateral side of the toothed wheel 5, with the bottom end 641 contacting a tooth face 521. Accordingly, the toothed wheel 5 is forced to rotate in a clockwise direction. At the start of rotation, the tooth face 521 on the opposite side of the toothed wheel 5 abuts against and thus urges the locating block 65 of the other push button 6 toward the adjacent lateral wall 46. Then the outer end of the tooth face 521 passes over the locating block 65, and the locating block 65 is resiliently restored to its home position extending into the next tooth space 52. At this time, the push button 6 is released and forced upward by the spring 62 with the locating block 65 ascending to engage with the tooth space 52 located on the toothed wheel 5. The push button is repeatedly depressed to sequentially change the displayed numerals until the finish end 532 of the arch block 53 abuts against the first stopper block 43. At this time, the toothed wheel 5 is prevented from further rotation, and the displayed numeral is the limiting numeral. At the last depression of the push button 6, the toothed wheel 5 is prevented from rotating because the first outer angle A is larger than the complementary first inner angle B defined by the wheel driving arm 64 and the contacted tooth face 521, and the second outer angle C is larger than the complementary second inner angle D defined by the direction of the action force of the wheel driving arm 64 and the forced tooth face 521. The result being that the force exerted by the wheel driving arm 64 onto the tooth face 521 is less than the resistance caused by the action of the first stopper block 43 against the finish end 532 of the arch block 53, thus, the wheel driving arm 64 cannot effectively force the tooth face 521, but instead slips along the tooth face 521 over the outer end 522. Therefore, the toothed wheel 5 is prevented from being driven and rotated.

Please refer to FIG. 11. In the case where the numerals of the toothed wheel 5 are controlled to be within an interval of 0-1, the arch block 53 extends from the start end 531 through a length of eight tooth spaces 52 to the finish end 532, which end 532 is positioned between numerals 6 and 7.

Figure 12:
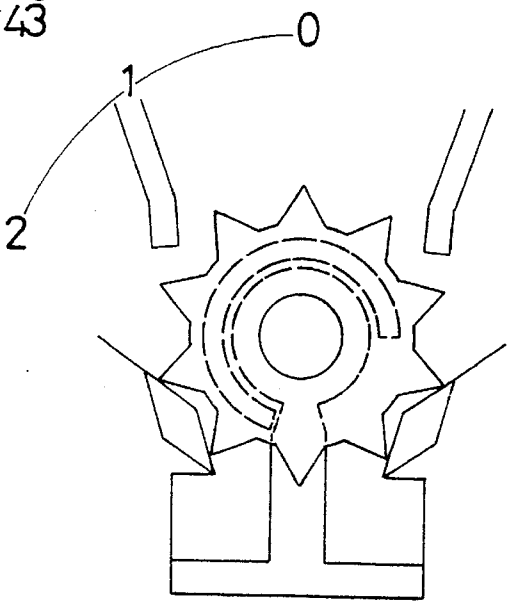

Please refer to FIG. 12. In the case where the numerals of the toothed wheel 5 are controlled to be within an interval of 0-2, the arch block 53 extends from the start end 531 through a length of seven tooth spaces 52 to the finish end 532 which is positioned between numerals 7 and 8.

Figure 13:
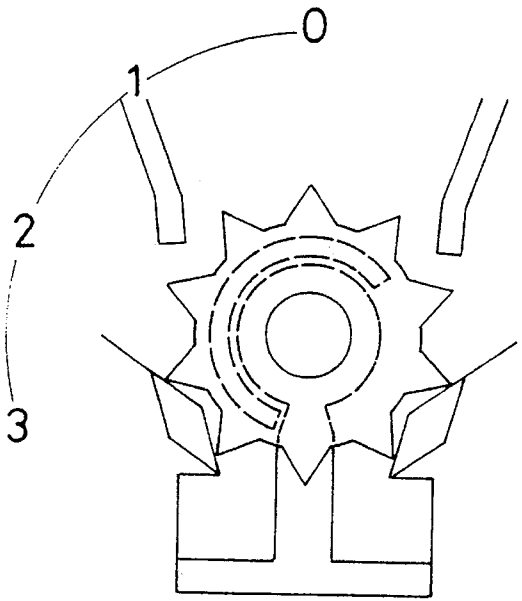

Please refer to FIG. 13. In the case where the numerals of the toothed wheel 5 are controlled to be within an interval of 0-3, the arch block 53 extends from the start end 531 through a length of six tooth spaces 52 to the finish end 532 which is positioned between numerals 8 and 9.

Figure 14:
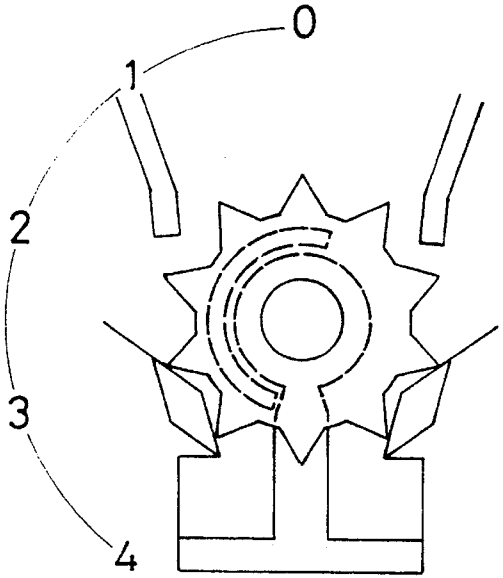

Please refer to FIG. 14. In the case where the numerals of the toothed wheel 5 are controlled to be within an interval of 0-4, the arch block 53 extends from the start end 531 through a length of five tooth spaces 52 to the finish end 532 which is positioned between numerals 9 and 0.

Figure 15:
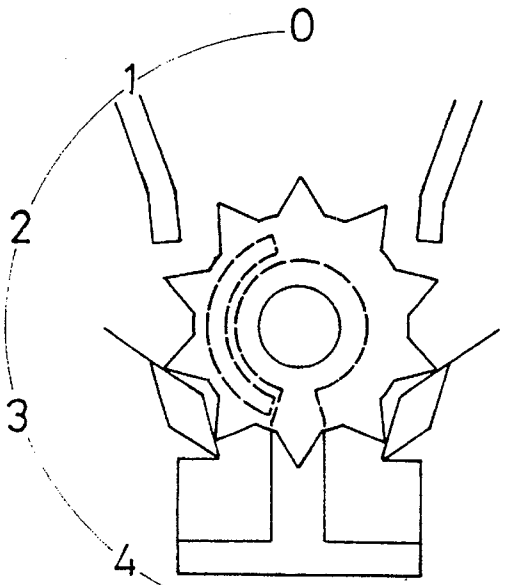

Please refer to FIG. 15. In the case where the numerals of the toothed wheel 5 are controlled to be within an interval of 0-5, the arch block 53 extends from the start end 531 through a length of four tooth spaces 52 to the finish end 532 which is positioned between numerals 0 and 1.

Figure 16:
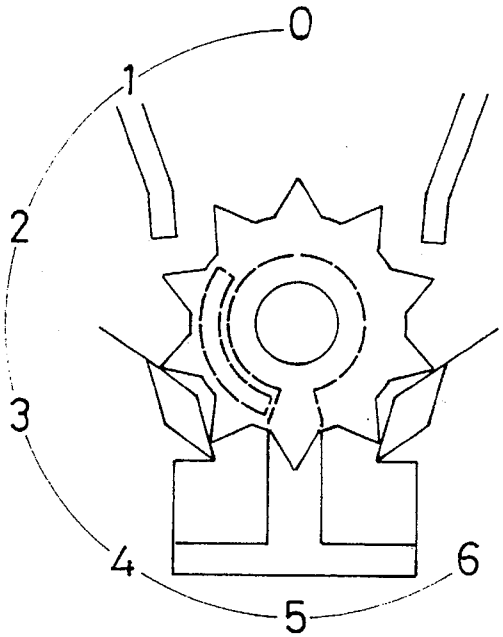

Please refer to FIG. 16. In the case where the numerals of the toothed wheel 5 are controlled to be within an interval of 0-6, the arch block 53 extends from the start end 531 through a length of three tooth spaces 52 to the finish end 532 which is positioned between numerals 1 and 2.

Figure 17:
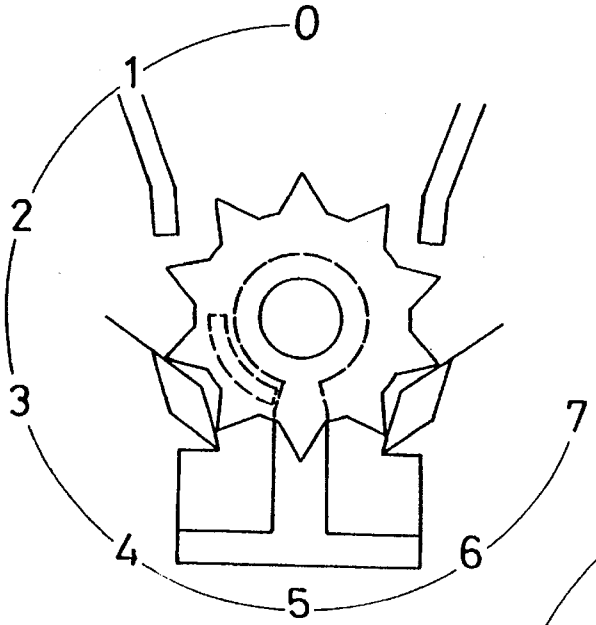

Please refer to FIG. 17. In the case where the numerals of the toothed wheel 5 are controlled to be within an interval of 0-7, the arch block 53 extends from the start end 531 through a length of two tooth spaces 52 to the finish end 532 which is positioned between numerals 2 and 3.

Figure 18:
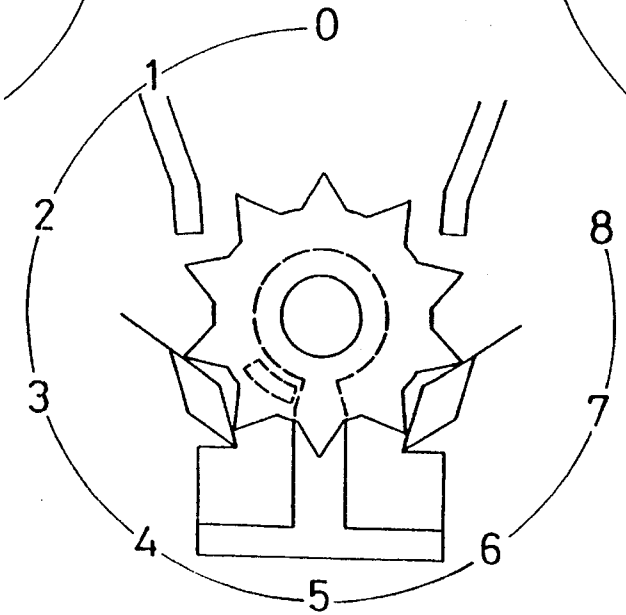

Please refer to FIG. 18. In the case where the numerals of the toothed wheel 5 are controlled to be within an interval of 0-8, the arch block 53 extends from the start end 531 through a length of one tooth space 52 to the finish end 532 which is positioned between numerals 3 and 4.

Figure 19:
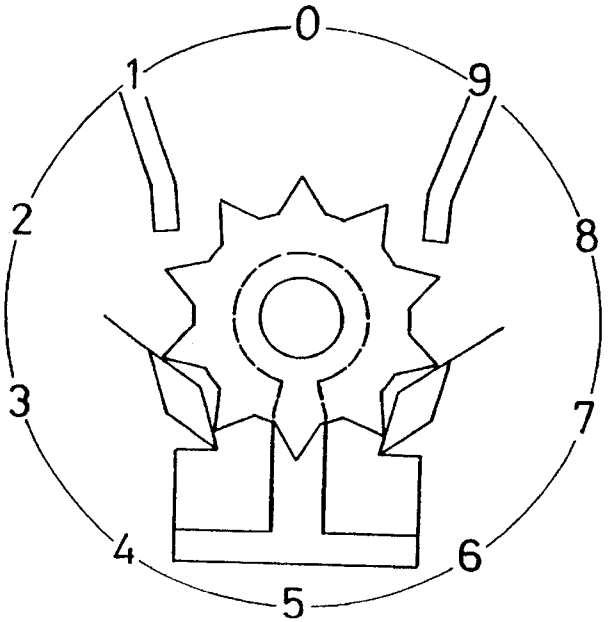

Please refer to FIG. 19. In the case where the numerals of the toothed wheel 5 are controlled to be within an interval of 0-9 and rotatably changed, the arch block is deleted from the toothed wheel 5.

The arch block 53 and the first stopper block 43 of the present invention are disposed within a larger space, so that the arch block 53 and the first stopper block 43 have a larger volume and greater strength.

Because the toothed wheel 5 has the arch block 53 on one side thereof and an arch space is left on the opposite side of the toothed wheel 5, the orientation of the toothed wheel 5 can be easily identified and thus the toothed wheel 5 can be easily mounted.

In addition, the toothed wheel 5 has totally identical tooth spaces 52 and tooth faces 521 and can be easily manufactured.

When depressed, the direction of travel of the push button 6 is restricted by the locating block 65, the slide rail 66 and the projection 661 so that the push button 6 is prevented from being undesirably shifted and damaged.

According to the above embodiments, a clearance exists between the push button 6 and the lateral wall 46 of the housing 4. When the toothed wheel 5 rotates causing the tooth face 521 to abut against the locating block 65 of the push button 6, the locating block 65 is permitted to move into the clearance, and is then restored to its home position by the spring 62.

Figure 20:
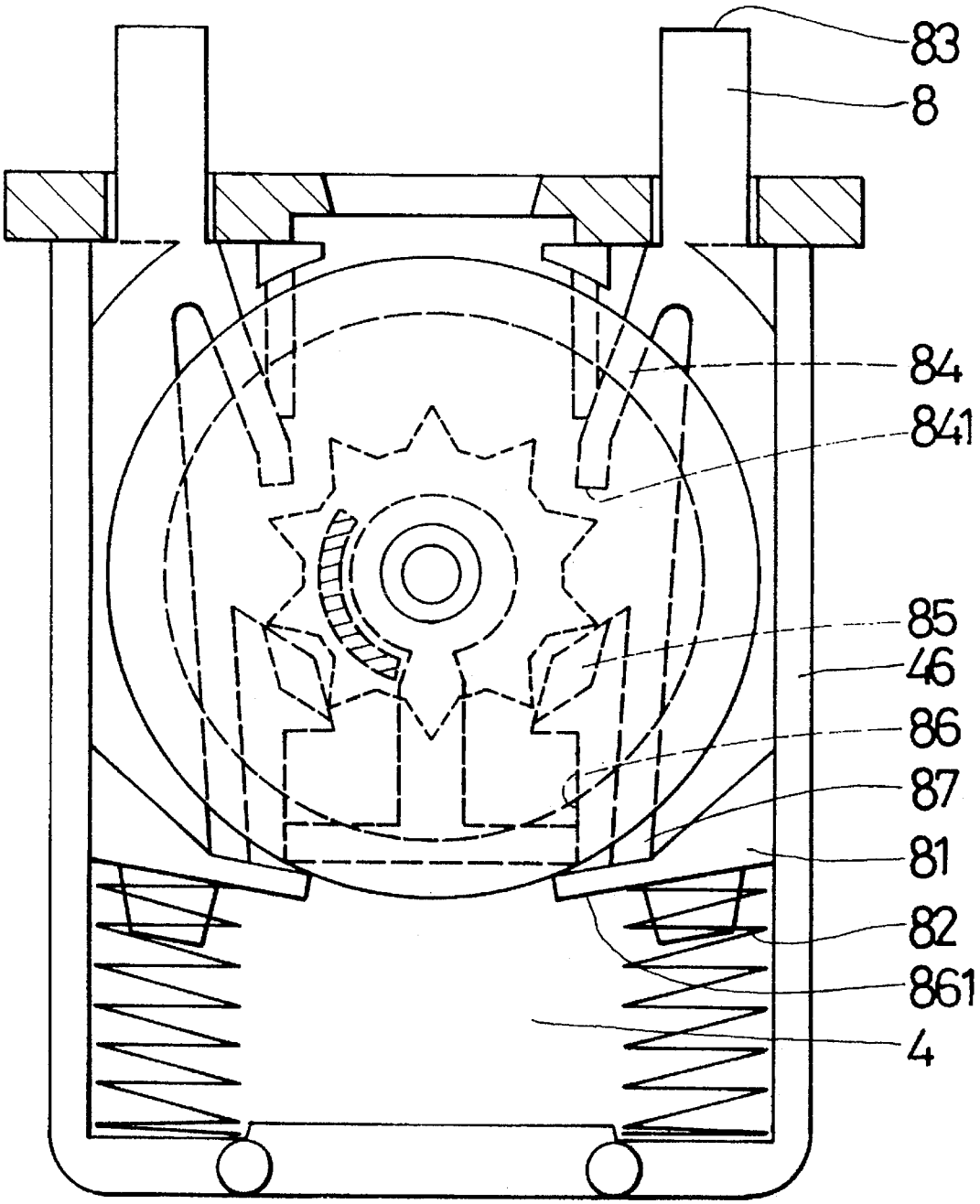
FIG. 20 shows an alternative push button of the present invention.

FIG. 20 shows an alternative push button 8 which includes a base sheet 81, a spring 82, a top end 83, a wheel driving arm 84 having a bottom end 841, a locating block 85 and a slide rail 86 having a projection 861. However, the push button 8 is formed with a notch 87 beside the locating block 85. The notch 87 provides a shifting space for the locating block 85 when forced. By means of such arrangement, the push button 8 is able to tightly lean against the lateral wall 46 of the housing 4.

It is to be understood that the above description and drawings are only used for illustrating some embodiments of the present invention, not intended to limit the scope thereof. Any variation or deviation from the above description and drawings should be included in the scope of the present invention.

What is claimed is:

1. A push wheel switch comprising:

a housing having a cavity open on one end formed by a bottom wall extending between a pair of longitudinally directed side walls and first and second end walls;

said first end wall having a pair of push button holes formed therethrough and a display window disposed between said pair of push button holes;

a circuit board positioned over said housing open end and forming a closure therefor;

an inner shaft seat extending from said housing bottom wall into said cavity, said inner shaft seat having attached thereto a longitudinally directed first stopper block, said first stopper block having a distal end to which is attached a pair of oppositely directed second stopper blocks, each of said pair of second stopper blocks being directed in a direction transverse said first stopper block;

a toothed wheel disposed within said cavity and having a shaft hole formed therethrough for rotatable coupling about said shaft seat, said toothed wheel having an outer peripheral surface defining a numeral face for displaying a predetermined number of display numerals through said display window, said toothed wheel having a predetermined number of peripheral tooth spaces, each of said peripheral tooth spaces being formed by a pair of opposing tooth faces;

an arch-shaped block integrally formed on said toothed wheel for establishing a rotational interval between a predetermined pair of said display numerals, said arch-shaped block being disposed concentrically between said shaft hole and said tooth spaces, said arch-shaped block including a start end and a finish end, each of said start and finish ends being adapted for rotational restriction by said first stopper block, so that said toothed wheel can rotate only between said predetermined pair of said display numerals; and, a pair of longitudinally directed push buttons disposed within said cavity and respectively positioned proximate to said housing side walls, each of said push buttons having an upper end and an opposing base seat end, said base seat end being biased by a respective spring for urging said respective upper end to protrude by a predetermined distance through a respective one of said push button holes and to press against a respective one of said pair of second stopper blocks, each of said push buttons having a wheel driving arm inclined toward the tooth spaces of the toothed wheel, said wheel driving arm being provided with a bottom end for pushing a respective tooth face of said toothed wheel, each of said push buttons having a lower locating block, each said lower locating block extending into respective lower tooth spaces on opposing sides of said toothed wheel, each driving arm being displaced to contact a respective tooth face of said toothed wheel responsive to a corresponding displacement of a respective push button, said displaced driving arm being adapted to transmit a force to said contacted tooth face at a predetermined angle with respect to said contacted tooth face for (1) rotatively displacing said toothed wheel when said rotative displacement is unrestricted by said first stopper block, and (2) slipping off an outer edge of said contacted tooth face when said rotative displacement of said toothed wheel is restricted by said first stopper block.

2. The push wheel switch as recited in claim 1 further comprising:

a pair of longitudinally directed rails extending from said first end wall, each of said rails being respectively positioned near said push button holes and having a lower free end formed with an inclined face for contacting said driving arm of a respective one of said push buttons to guide said wheel driving arm toward said tooth space of the toothed wheel.

3. The push wheel switch as recited in claim 1, wherein each of said push buttons includes a slide rail disposed under said lower locating block for abutment against said second stopper block, a bottom end of each slide rail having formed thereon a projection to be stopped by a respective one of said second stopper blocks.

4. The push wheel switch as recited in claim 1, wherein said start end of said arch-shaped block abuts said first stopper block when a display numeral 0 is positioned at said display window.

* * * * *